US005112029A

United States Patent [19]

Lazcano-Navarro et al.

[11] Patent Number: 5,112,029

[45] Date of Patent: May 12, 1992

[54] QUICK FLUID INJECTION ASSEMBLY REPLACEMENT IN METALLURGICAL REACTERS

[75] Inventors: Arturo Lazcano-Navarro; Gregorio Vargas-Gutierrez; Jose E. Hernandez-Ruiz; Carlos Maroto-Cabrera, all of Saltillo, Mexico

[73] Assignee: Instituo Mexicano de Investigaciones Siderurgicas, Mexico

[21] Appl. No.: 733,423

[22] Filed: Jul. 22, 1991

[51] Int. Cl.[5] ..... C21B 7/16

[52] U.S. Cl. ..... 266/47; 266/265; 266/270

[58] Field of Search ..... 266/265, 270, 217, 44, 266/45, 47

[56] References Cited

U.S. PATENT DOCUMENTS 4,522,376 6/1985 Langenfeld ..... 266/265

5,649,043 9/1985 Miyawaki et al. ..... 266/265

*Primary Examiner*—Scott Kastler

*Attorney, Agent, or Firm*—Laurence R. Brown

[57] ABSTRACT

The present invention relates to a method and a fluid injection device for quick replacement, even in the red hot conditions, in a metallurgical reactor. The method comprises the external extraction of the injection device which is composed of an inner extractable blowing element and wear resistant block, element the blowing element secured in the wear resistant block and forming together the injection device. The quick interchange is first performed by extracting the inner blowing element, then installing a special extractor device in the space where the blowing element was and then extracting the wear resistant block by applying a force, in the opposite direction of the gas flow, through the bottom end of the extractor device. The extractor device has a special design so, when a force is applied at its bottom end, an expansive occurs at the upper end making the external extraction of said wear resistant block easier.

10 Claims, 6 Drawing Sheets

QUICK FLUID INJECTION ASSEMBLY REPLACEMENT IN METALLURGICAL REACTERS

BACKGROUND OF THE INVENTION

During the last two decades a great number of gas injection devices have been reported to be used in metallurgical reactors containing liquid metals. The main differences between most of them deal with design aspects such as number and distribution of gas passages; gas distribution chamber geometry and location; use or not of a metallic can surrounding the refractory element; use of porous or solid refractories; methods for assembling all the components; etc. Little attention has been paid to the practical aspect of interchange of an injection device. This aspect is of great importance because the replacement operation, if takes too much time, costs more and decreases the availability of the metallurgical reactor.

It is upon the experience of the authors of this invention, in designing and using injection devices for the treating of liquid metals in industrial metallurgical reactors, that a method has been found to overcome the main problems associated with the gas injection technology.

Two possible solutions appear to be the most effective for the interchangeability aspect: to install a long life injection element or to install an interchangeable element with a design oriented toward the solution of problems encountered during the replacement operations.

The long life characteristic in an injection device is related to the wearing produced by the "back attack" phenomenon resulting in a high wearing rate. This phenomena is increased when the refractory of the injection device is porous. The quick interchangeability of an injection device depends on the following factors: presence of a metallic "mushroom" on the hot face of the injection device; diffusion or reaction bonding between the lateral surface of the injection element and the surrounding refractory brick; and having means to apply a force in the opposite direction to the gas flow (in the injection element) and means to transmit said force at all points of the injection element in order to extract it.

It is, therefore, an object of this invention to provide an injection device to be used in metallurgical reactors with an improved design to operate for long periods withstanding operation conditions with little or no wearing.

It is another object of the present invention to provide an injection device to be used in metallurgical reactors with an improved design that may be replaced quickly.

SUMMARY OF THE INVENTION

The present invention relates to an injection device to be used in metallurgical reactors containing liquid metals. The injection device is designed for long operation periods with low wearing rate and a method to replace said injection device quickly is disclosed. The injection device comprises three main components: the blowing element, the wear resistant block and the sleeve.

The long life characteristic of the injection device is achieved through the following features:

a) The refractory body which conforms the wear resistant block is prepared by isostatic pressing of the raw powder materials, followed by a special sintering cycle in order to achieve high mechanical properties.

b) The gas passage in the blowing element is at least one slit, running from the bottom to the hot face of the blowing element, having a big enough transverse area to permit the needed gas flow rate at pressures high enough to avoid the "back attack" phenomenon, and small enough to avoid liquid metal penetration in the slit when the gas flow is cut-off. This feature allows for high kinetic stirring energy concentration and permits a wear protecting mushroom to be formed around the hot face of the blowing element, being solidified by gas cooling.

The quick interchangeability of the injection device is allowed through the following features:

a) A ceramic coating is applied on both hot faces: the one of the blowing element and the one of the wear resistant block. This coating is of the type that is not wetted by liquid metal, avoiding the diffusion bonding between the mushroom and the wear resistant block. This feature allows easy extraction of said components.

b) The blowing element is enclosed in a metallic pipe with means, at the bottom end, to be extracted by applying a force in the opposite direction of the gas flow. The blowing element can be replaced without replacement of the wear resistant block.

A special feature of the blowing element which is used as safety and wear indicator means, is that the slits (at least one) running from the bottom to the hot face of the blowing element, are surrounded, from the middle of the total height to the bottom, by a metallic conduit whose inner transverse section is at least equal to the sum of the transverse area of said slits in the blowing element.

A ceramic coating is applied on the surface of said metallic pipe in order to avoid diffusion bonding between said metallic pipe and the wear resistant block. This coating allows for easy extraction of the blowing element.

c) The wear resistant block has a truncated conical shape being the hot face the lower transverse area, and can terminate at the bottom end in a cylindrical shape, with means at the bottom end to be extracted by applying a force in the opposite direction of the gas flow. A ceramic coating is applied on the vertical surface of the said wear resistant block in order to avoid diffusion bonding between said wear resistant block and the sleeve. This coating allows easy extraction of the wear resistant block.

The method for a quick interchange of the injection device comprises the following steps:

a) Removal of the blowing element.

b) Installation of an extraction device inside the space where the blowing element was.

c) Removal of the wear resistant block using the extraction device.

d) Performance of a cleaning operation to remove traces of coating and wear resistant block.

e) Installation of a new injection device.

DETAILED DESCRIPTION OF THE INVENTION

Conventional porous plugs or related injection elements and DPP (Directional Porosity Plugs) usually fail in obtaining both wear resistance and good performance as injection device, i.e. a good injection device usually has low wear resistance. On the contrary, an injection device having good wear-resistance usually performs as a low-injection capacity device.

One of the main objects of this invention is to bring both high wear resistance and high injection performance into one injection device. Said blowing element has high injection performance and a wear resistant block has a high operation life because of its high wear resistance.

Figure 1:
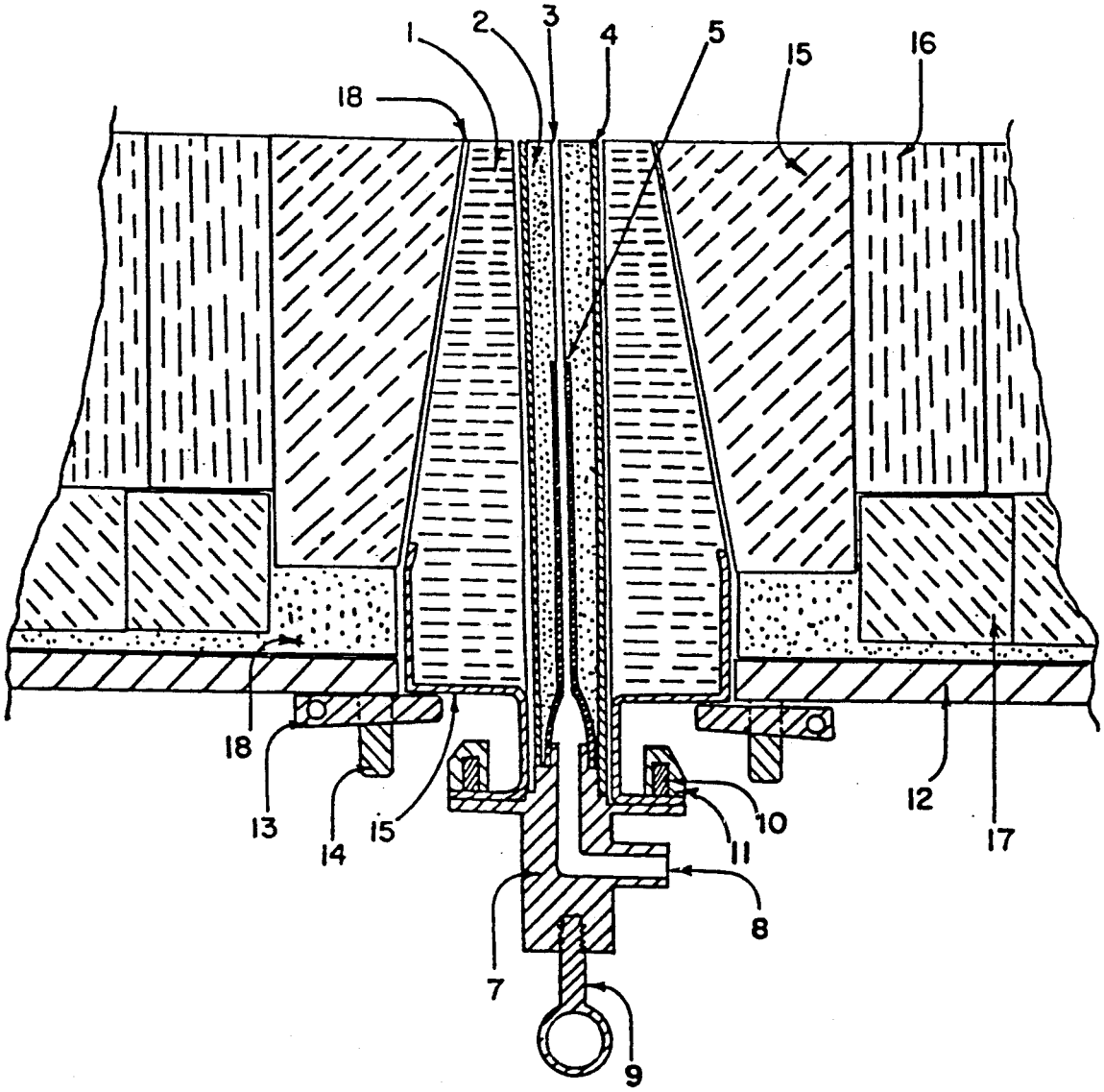
FIG. 1 is a longitudinal cross-sectional representation of the device of this invention assembled and mounted in the bottom of a metallurgical vessel.

The long life characteristic of the injection device can be further explained using FIG. 1 as an example:

A blowing element is composed of an outer metallic pipe (4), an inner metallic pipe (5), a ceramic body (2), a metallic body (7) extraction coupling (9), fixing clamps (11), one blow fluid inlet port (8) and at least one slit-shaped passageway (3) for blowing fluids into the liquid metal contained in a metallurgical vessel.

The construction of said blowing element allows blowing fluids such as argon, nitrogen or natural gas at pressures higher than in conventional porous plugs. It is well known by those skilled in the field of pneumatic metallurgy that blowing at higher pressures minimizes the frequency of the "back-attack" phenomenon. This "back-attack" phenomenon is well known to be the main reaction responsible for the high wear rate found in the hot face of conventional injection devices.

When high flow rates are used to stir the metallic bath, the cooling effect of the gas blown into the liquid metal causes the solidification of the same over the hot face of the injection device; this solidified metal is known as "mushroom". The presence of such "mushroom" also minimizes the wear rate of the injection device, protecting it from the "back-attack".

Figure 3:
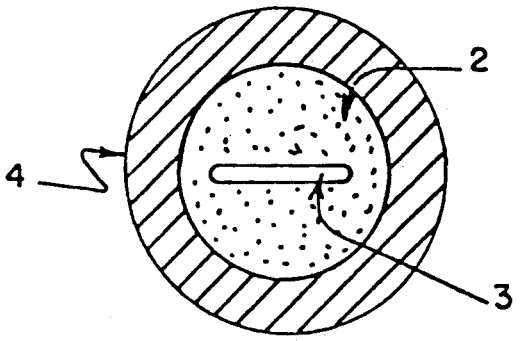
FIG. 3 is a detail of FIG. 2, showing a radial cross-sectional view of the blowing element. This is the initial hot face in contact with liquid metal.

Conventional injection devices also fail in promoting the "mushroom" formation because they have multiple injection ports distributed in a relatively big area. Said blowing element which is part of this invention overcomes this problem by concentrating at least one injection port in a relatively small area, as shown in FIG. 3 as an example. This flowing area is small enough to provoke "mushroom" formation even at low fluid flow rates.

Figure 2:
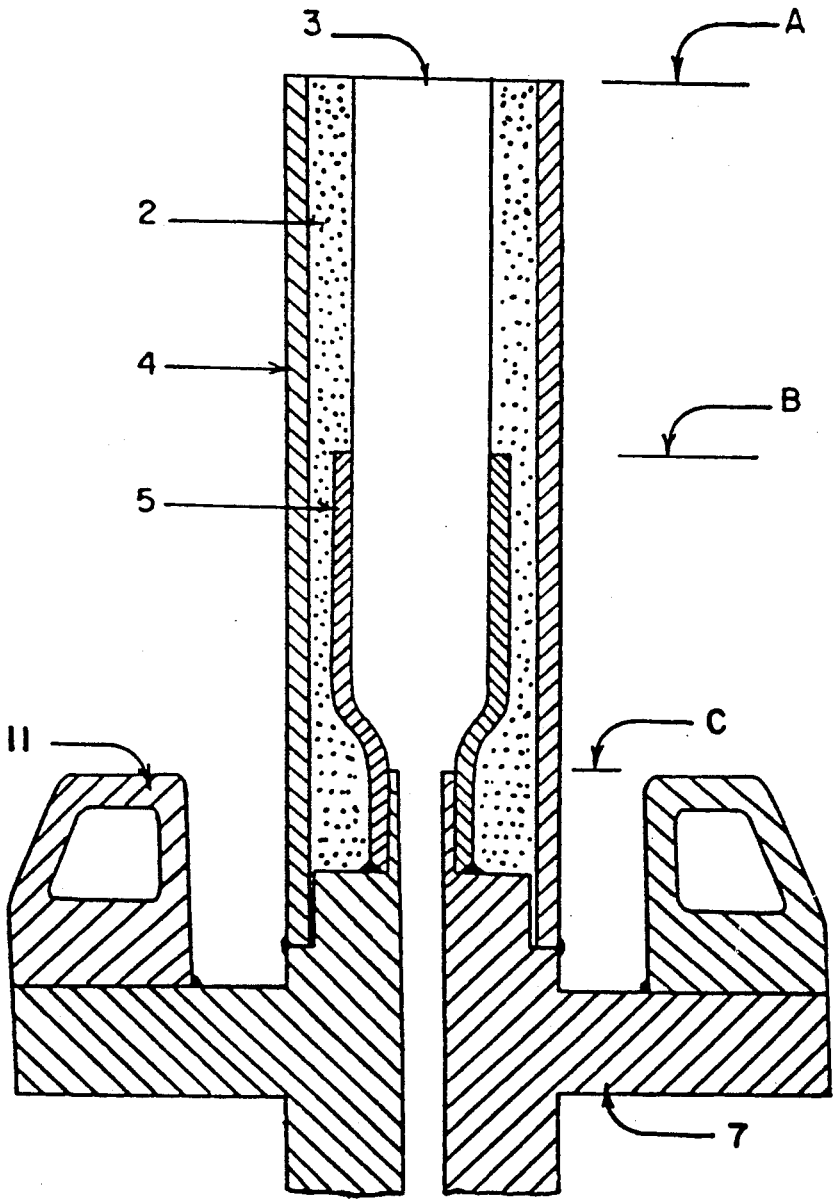
FIG. 2 is a detail of FIG. 1, showing central portion of the injection device, named blowing element.

FIG. 2 is a longitudinal cross-sectional representation of a possible configuration of said blowing element as an example. An additional feature of said blowing element is the possibility of stopping completely the flow while having liquid metal in the vessel without blockage of the blowing element. This is done carefully designing the outlet port (3), in a manner such that the liquid metal's superficial tension avoids infiltration of liquid metal through the narrow gap of the slit-like outlet port (3). The working length of the blowing element, represented in FIG. 2 by section A to section B, has the flow passageway constructed of ceramic material in order to avoid blockage of outlet port (3) by welding, due to high temperature of the liquid metal, of the metallic conduit surrounding said slit if it were prolongated until the hot face of the blowing element.

Figure 4:
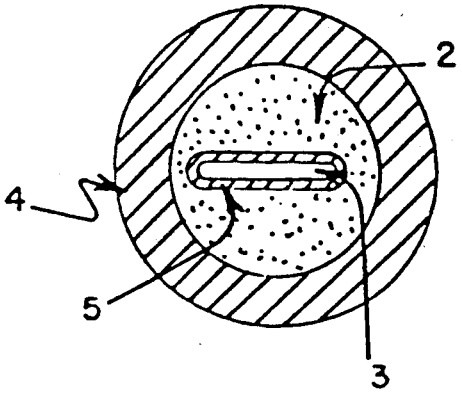
FIG. 4 is a detail of FIG. 2, showing a radial cross-sectional view of the blowing element. This is the limit working face for said injection device.
Figure 5:
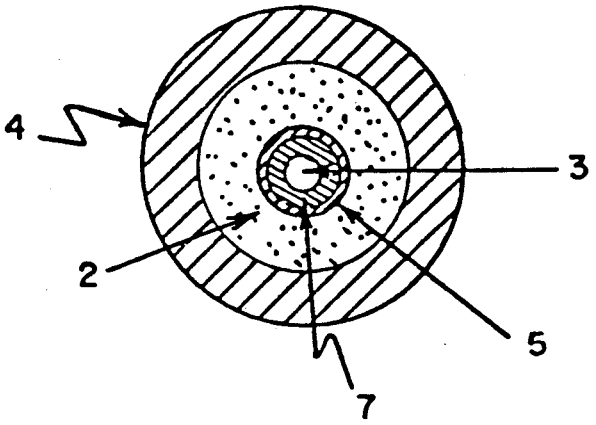
FIG. 5 is a detail of FIG. 2, showing a radial cross-sectional view of the blowing element at a point of assembly.

At the end of the working length of the blowing element, section B of FIG. 2 and also represented in FIG. 4 as a radial cross-sectional view, the flow passageway is formed by a metallic pipe (5). In the event of having worn the blowing element to such point, the tip of said metallic pipe (5) is welded by the high temperature of the liquid metal when the fluid supply is stopped, making it impossible to continue using the blowing element beyond this safety point and making imperative the replacement of blowing element.

A long-enough length of metallic pipe (5) is left to avoid leaks of liquid metal.

Said blowing element inserted in said wear-resistant block (1) and fixed to it by means of a flanged metallic base (6), fixing clamps (11) and wedges (10). Said wear-resistant block (1) fabricated using ceramic powder isostatically pressed into a mould near-shaped to the truncated cone shape, having a cylindrical hole running along the central axis of said wear resistant block (1) to allocate said blowing element.

Said wear-resistant block (1) having a flanged metallic base in the cold face (6) is used as means to allow the extraction from the ceramic sleeve (15) and to support said blowing element.

FIG. 1 also represents the injection device installed the bottom of a metallurgical vessel. Said ceramic sleeve (15) is surrounded by working refractory bricks (16) and safety lining refractory bricks (17). A refractory castable mix (18) is used to adjust and fill between said ceramic sleeve (15) and the metallic shell (12).

Besides the long-life characteristic present in the injection device object of this invention, its design allows the use of the following method for a quick replacement, which also is an object of the invention.

The blowing element is designed for easier extraction from the wear resistant block 1.

The extraction of this blowing element will be necessary when there is an occasional clogging; i.e., excessive metal-slag build-up and solidification of the same. In this event, it is not necessary to replace the wear-resistant block (1), only the blowing element.

Figure 6:
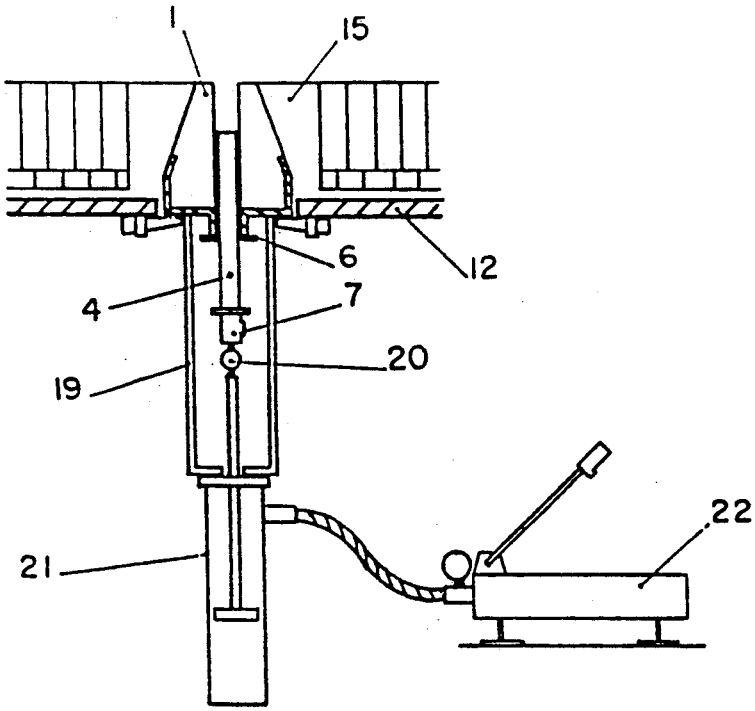
FIG. 6 is a longitudinal cross-sectional representation similar to FIG. 1, showing an arrangement to extract the blowing element out of the named wear-resistant block, by means of a hydraulic device.

FIG. 6 illustrates an arrangement used for extraction of this blowing element.

A hydraulic device composed of hydraulic piston (21), hydraulic pump (22), supporting legs (19) and shaft connector (20) which are used to extract the blowing element out of the wear resistant block by connecting the shaft connector (20) to the extraction coupling (9) located at the low-end of said blowing element and applying a force parallel to the central axis of said blowing element. FIG. 6 shows half-way extraction of said blowing element out of said wear-resistant block (1).

Figure 7:
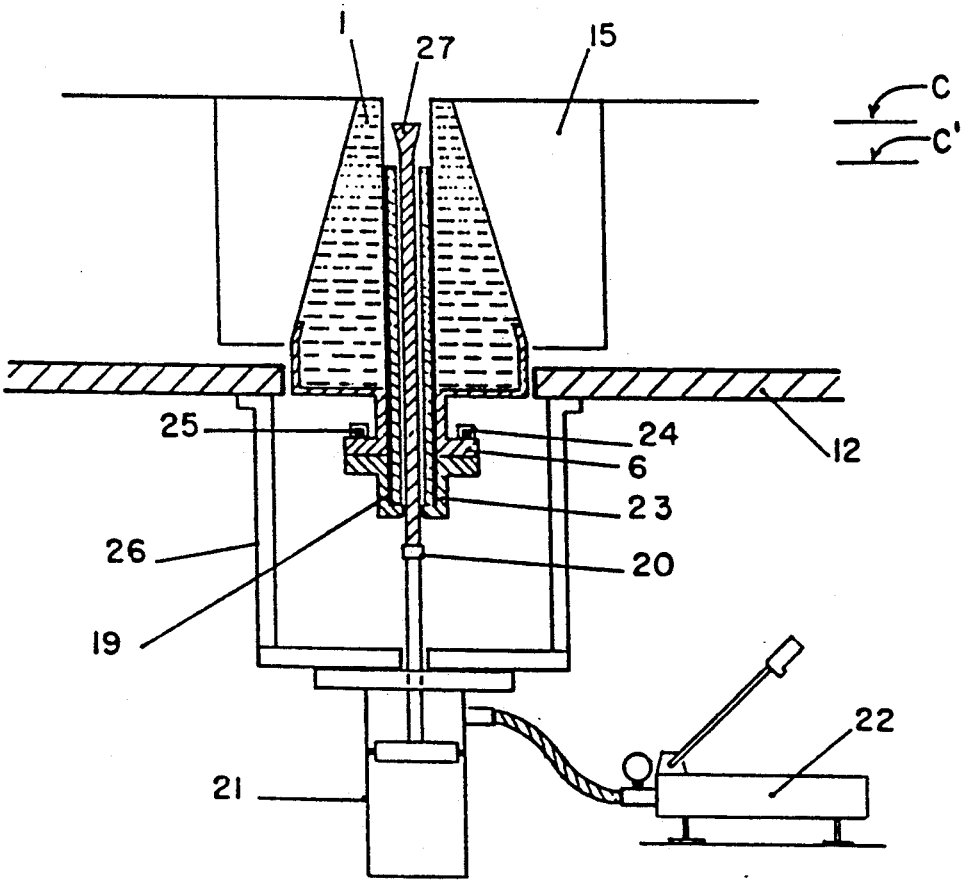
FIG. 7 is a longitudinal cross-sectional representation of an arrangement to extract the wear-resistant block out of the sleeve, by means of a hydraulic device.

The replacement of the wear-resistant block (1) will be necessary when it reaches a safety limit length at its longitudinal axis. This safety limit corresponds to the tip of the inner metallic pipe (5), located in the blowing element. In this event, the first step for extracting said wear-resistant block (1) is to proceed to extract the blowing element as hereinbefore described. In doing so, a hole through the central axis of said wear-resistant block 1 is available to allocate said extraction device. The second step for extracting the said wear-resistant block 1 is illustrated using FIG. 7 as an example:

A said extraction device formed by metallic pipe (26), wedged rod (27), force transmitting flange (23) and shaft-coupling (20) is inserted into said wear-resistant Block (1) and fixed to it by means of clamps (24) and wedge (25).

The extraction force is provided by a hydraulic device comprising hydraulic piston (21), hydraulic pump (22) and supporting legs (19).

Figure 8:
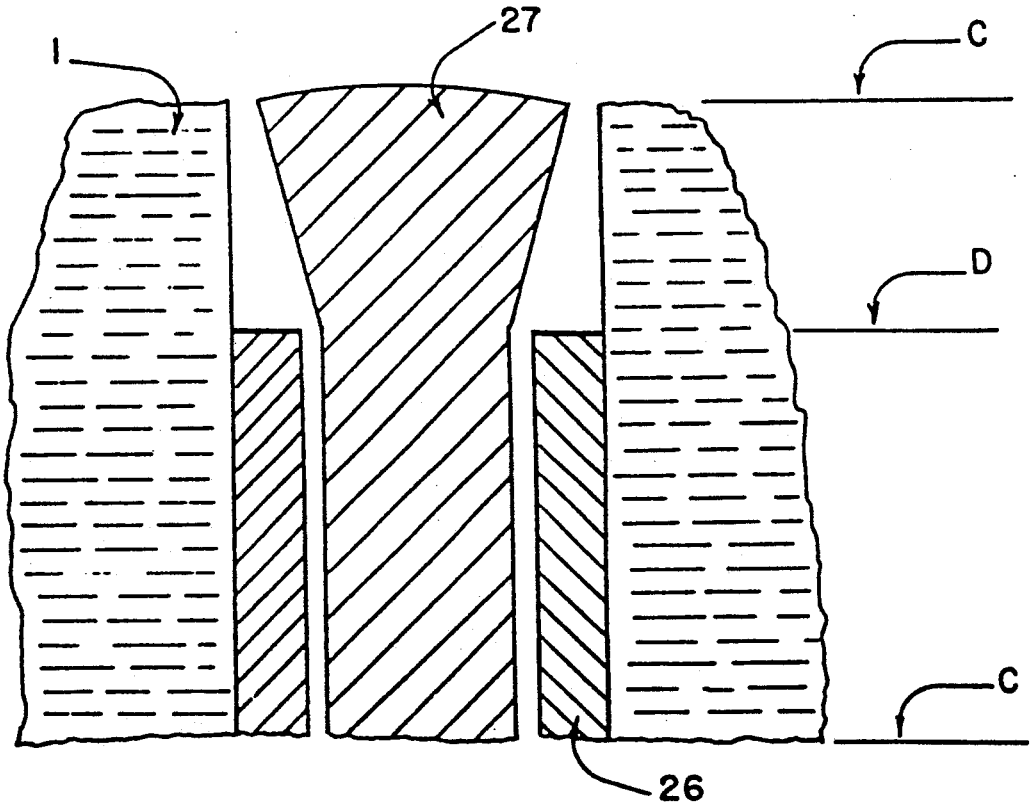
FIG. 8 is a detail of FIG. 7, amplifying section C—C', showing the upper portion of said extraction device.
Figure 9:
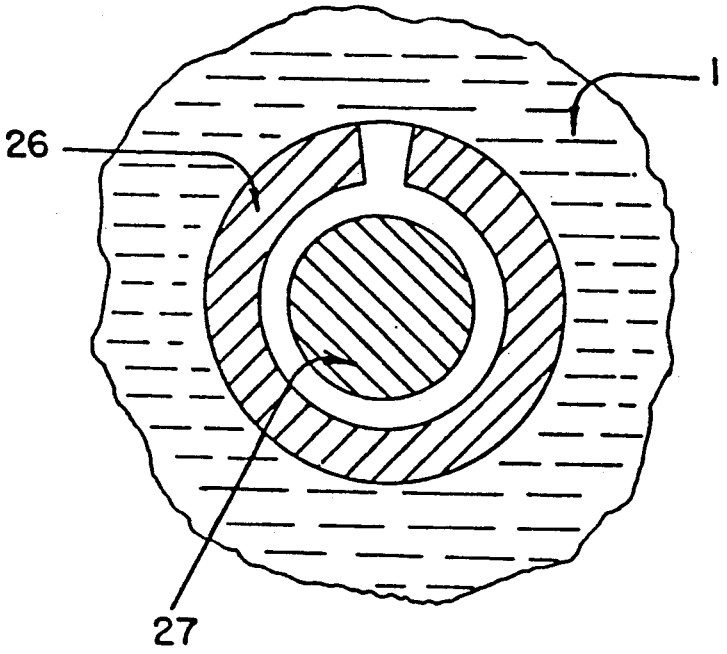
FIG. 9 is a detail of FIG. 8, showing a radial cross-sectional representation of the upper portion of said extraction device.

FIG. 8 and FIG. 9 show a detail of said extraction device before application of the extraction force. When this extraction force is applied, said wedged rod (27) expands the tip of said metallic pipe (26) and said metallic pipe (26) transmits extraction force to the low-end of said wear-resistant block through force-transmitting flange (23) connected to said flanged metallic base (6).

By this extraction method, extraction force is applied along the longitudinal axis of said wear-resistant block (1), avoiding its eventual fracture and failure in its full extraction. This problem is commonly found in actual designs of injection devices and it is another of the main objects of this invention to overcome such situation.

The following are examples of applicability of the injection device in steelmaking:

EXAMPLE 1. LADLE OPERATIONS

In this case the injection device operates intermittently: during steel transfer operation there is no gas bubbling; this is only possible when the ladle arrives to some station (vacuum or reheating).

The injection device for this type of operation is prepared as follows: The sleeve can be manufactured by pouring high alumina refractory in a mould a followed by a curing thermal cycle; the wear resistant block is prepared by isostatic pressing of high alumina refractory powder followed by a sintering cycle; the bubbling element can be of the multi-slit or single slit type and can be interchanged several times before replacing the wear resistant block. The number of blowing element interchanges depends on the wearing rate of the wear resistant block.

The wear safety system acts as follows: when the wear reaches the level where slits are surrounded by the metallic conduit and after gas flow cut-off, a welding process occurs at the metallic surrounded area clogging the bubbling element. Further ladle utilization, after said clogging, will produce neither, gas bubbling nor wearing, and the wear resistant block is replaced.

EXAMPLE 2. ELECTRIC ARC FURNACE OPERATIONS

In this case a continuous bubbling operation is required during all stages of the EAF process (melting, refining and tapping).

The injection device for this type of operation is prepared as follows: the sleeve and the wear resistant block are prepared by isostatic pressing of a refractory powder followed by a sintering cycle. The refractory powder for this application is selected from the group consisting of: magnesite, magnesite-carbon, magnesite-alumina, magnesite-chromite and zirconia. The bubbling element can be of the multi-slit type or single slit type, the single slit type is preferred. This bubbling element is interchanged several times before replacing the wear resistant block depending on its wear rate. This practice allows a long life of the injection device due to the fact that the bubbling element is replaced, as many times as necessary before wearing reaches the wear resistant block. The wear resistant block is replaced when all the furnace bottom lining requires maintenance.

Although the invention has been described in detail with respect to certain embodiments, those skilled in the art will recognize that there are other embodiments of this invention within the spirit and scope of the claims.

We claim:

1. A fluid injection assembly in a metallurgical reactor for treating liquid metals permitting the quick interchange of fluid injection main components, said assembly including;

a) An interchangeable blowing element composed of an exterior metallic pipe containing a ceramic body which has at least one passage-way connecting one inlet port with at least one outlet port, wherein said passage-way is surrounded by a metallic conduit only part way upwardly from the bottom of said blowing element to mate at an intersection with at least one hole in said ceramic body for operation with higher supply pressures and completely stopped feed of fluid while avoiding fusion and clogging of said passage-way, means for connecting said blowing element to a fluid supply, and providing at said intersection means operable when said passage-way is clogged to require replacement of said interchangeable blowing element for extracting the blowing element;

b) an interchangeable wear-resistant block having a truncated conical shape and having a cylindrical centered hole running along the longitudinal axis for receiving said blowing element, a flanged metallic base for said block to secure therein the blowing element; said cylindrical hole being adapted to receive an extraction device for removing the block after extraction of said blowing element from the hole; and c) means to facilitate the extraction of the said blowing element from said wear-resistant block consisting of a ceramic coating applied to the external surfaces of said blowing element thereby avoiding bonding at the joint between said ceramic body and said wear-resistant block and wear caused by high temperature chemical diffusion.

2. The assembly defined in claim 1 further comprising a ceramic coating applied to the external surfaces of said wear resistant block to avoid bonding and wear.

3. The fluid injection assembly of claim 1 wherein the passage-way of the ceramic body contained in said interchangeable blowing element is shaped as a central slot dimensioned to avoid liquid melt penetration and hence clogging of said passage-way.

4. The fluid injection assembly of claim 1 wherein said wear-resistant block comprises an isostatically pressed and sintered powdered refractory material exhibiting high wear resistance, high hot modulus of rupture and low liquid metal wetability.

5. The fluid injection assembly of claim 4 for use with a metallurgical reactor utilizing a treating ladle wherein said powdered refractory material is selected from the group consisting of: high alumina, silica-alumina, magnesite-chromite and temperized dolomite.

6. The fluid injection assembly of claim 4 for use with an electric arc furnace metallurgical reactor wherein said powdered refractory material is selected from the group consisting of: magnesite, magnesite-carbon, magnesite-alumina, zirconia and magnesite-chromite.

7. A method of interchanging fluid injection components in a metallurgical reactor for treating liquid metals comprising an independently interchangeable blowing element and wear-resistant block with a cylindrical hole for receiving the blowing element, comprising the steps of:

a) forming a coating of a ceramic of a type not melted by liquid metal on hot faces of the blowing element and wear resistant block;

b) extracting the interchangeable blowing element from the wear-resistant block by use of an external force applied opposite to the gas flow direction;

c) cleaning the hole left by said blowing element into the wear-resistant block by removing residuals of the ceramic coating;

d) inserting into the cylindrical hole extracting means and applying an extracting force for removing said wear-resistant block from the reactor, and e) cleaning the hole left by said wear-resistance block by removing residuals of said wear-resistance block and ceramic coating.

8. The method of claim 7 wherein the steps in removing the wear resistant block further comprise the steps of: expanding a metallic pipe inserted into the cylindrical hole against the wall of said hole of said wear-resistance block with a wedge bar, and applying said extracting force to the wedge bar thereby transmitting said force to remove said wear-resisting block by distribution of the applied extraction force by means of the metallic pipe to the cylindrical hole in said wear-resistant block.

9. The method of claim 7 wherein the extracting means for the wear-resistant block comprises a metallic bar of diameter close to that of the cylindrical hole and an end of said metallic bar has a slot containing a pivoting bar having a length similar but not longer than a hot face diameter on said wear-resistant block with a pivoting point located in the metallic bar and further comprising the step of inserting the metallic bar into said hole in said wear-resistant block far enough to engage the hot face with the pivoting bar.

10. A method as claimed in claim 7 wherein the step of forming the ceramic coating further comprises the step of selecting a ceramic for the coating from the group consisting of: zirconia, ps-zirconia, alumina, magnesite, chromite, graphite and mixture of them.

* * * * *